US007743886B2

(12) United States Patent
Feemster, Jr. et al.

(10) Patent No.: US 7,743,886 B2
(45) Date of Patent: Jun. 29, 2010

(54) SYSTEMS FOR STABILIZING LADDERS

(76) Inventors: Kuyler Barron Feemster, Jr., 2510 Steele Rd., Griffin, GA (US) 30223; D. Curtis Mann, 517 Broyles St., Atlanta, GA (US) 30312

( * ) Notice: Subject to any disclaimer, the term of this patent is extended or adjusted under 35 U.S.C. 154(b) by 1014 days.

(21) Appl. No.: 11/453,539

(22) Filed: Jun. 15, 2006

(65) Prior Publication Data

US 2007/0289812 A1 Dec. 20, 2007

(51) Int. Cl.
*E06C 5/00* (2006.01)

(52) U.S. Cl. ..... 182/107; 182/129; 52/155; 52/156; 52/158; 52/162; 52/164

(58) Field of Classification Search ..... 182/107, 182/109, 111, 129, 165, 203, 206, 216, 230; 52/155, 156, 158, 162, 164; 114/299, 304, 114/306
See application file for complete search history.

(56) References Cited

U.S. PATENT DOCUMENTS

| | | | | | |
|---|---|---|---|---|---|
| 55,593 | A | * | 6/1866 | Dinzey | 114/306 |
| 57,339 | A | * | 8/1866 | Latham | 114/306 |
| 298,867 | A | * | 5/1884 | Lewis | 114/306 |
| 625,066 | A | * | 5/1899 | Seagrave | 182/111 |
| 776,446 | A | * | 11/1904 | Williamson | 182/107 |
| 840,365 | A | * | 1/1907 | Pease | 182/107 |
| 957,621 | A | * | 5/1910 | Neal | 114/303 |
| 1,352,323 | A | * | 9/1920 | Stephan | 182/109 |
| 1,521,814 | A | * | 1/1925 | Houska | 182/165 |
| 1,710,026 | A | * | 4/1929 | McCormick | 248/238 |
| 2,523,535 | A | * | 9/1950 | Little | 182/107 |
| 2,574,286 | A | * | 11/1951 | Rein | 182/165 |
| 2,959,145 | A | * | 11/1960 | Galloway | 114/310 |
| 2,993,561 | A | * | 7/1961 | Watson | 182/195 |
| 3,022,761 | A | * | 2/1962 | De Beixedon | 114/306 |
| 3,118,416 | A | * | 1/1964 | Sawyer | 114/297 |
| 3,527,187 | A | * | 9/1970 | Stalcup et al. | 114/302 |
| 3,557,739 | A | * | 1/1971 | Kaercher | 114/299 |
| 3,783,815 | A | * | 1/1974 | Towne et al. | 114/303 |
| 3,977,351 | A | * | 8/1976 | Watterback | 114/306 |
| 4,386,575 | A | * | 6/1983 | Brown | 114/299 |
| 4,545,318 | A | * | 10/1985 | Eberline | 114/299 |
| 4,576,250 | A | * | 3/1986 | Marish | 182/108 |

(Continued)

FOREIGN PATENT DOCUMENTS

| | | | |
|---|---|---|---|
| GB | 2099060 | A * | 12/1982 |

(Continued)

*Primary Examiner*—Katherine W Mitchell
*Assistant Examiner*—Colleen M Quinn
(74) *Attorney, Agent, or Firm*—Thomas, Kayden, Horstemeyer & Risley, LLP

(57) ABSTRACT

Systems for stabilizing ladders are provided. A representative system incorporates a ladder stabilizing assembly that includes a mount, a frame and a spike. The mount is configured to attach to a ladder. The frame extends from the mount and is movable between a stowed position, in which the frame is located adjacent the ladder, and an un-stowed position, in which the frame extends outwardly from the ladder. The spike extends from the frame and is operative to be driven into the ground such that, when the frame is in the un-stowed position and the spike is driven into the ground, the ladder stabilizing assembly provides support to the ladder.

14 Claims, 6 Drawing Sheets

U.S. PATENT DOCUMENTS 4,798,159 A * 1/1989 Taylor et al. ..... 114/295
4,971,167 A * 11/1990 Winnard ..... 182/107
5,337,856 A * 8/1994 Fillers ..... 182/107
5,394,818 A * 3/1995 Walker et al. ..... 114/294
5,400,516 A * 3/1995 Kellenberger ..... 33/295
5,404,831 A * 4/1995 Miller ..... 114/306
5,590,739 A * 1/1997 High et al. ..... 182/169
5,850,715 A * 12/1998 Francis ..... 52/155
5,890,560 A * 4/1999 Sloop ..... 182/107
5,918,699 A * 7/1999 Summers ..... 182/107
6,089,350 A * 7/2000 Hankins ..... 182/107
6,105,722 A * 8/2000 Taylor ..... 182/180.2
6,955,243 B1 * 10/2005 Huff ..... 182/107
7,437,854 B1 * 10/2008 O'Reilly ..... 52/27
7,445,086 B1 * 11/2008 Sizemore ..... 182/107

FOREIGN PATENT DOCUMENTS

GB 2172044 A * 9/1986

* cited by examiner

SYSTEMS FOR STABILIZING LADDERS

BACKGROUND

Ladders come in various sizes and configurations for both indoor and outdoor use. By way of example, some typical ladders are configured as collapsible A-frame structures that tend to be self-supporting. Others are configured for leaning against a structure, such as an exterior wall of a building.

Regardless of the configuration, stability of a ladder is an important consideration. In this regard, it is always recommended that in addition to the worker on the ladder, an additional worker be located at the base of the ladder in order to stabilize the ladder. Unfortunately, many workers operate independently and oftentimes scale and work atop ladders without having another worker support the ladder from below.

SUMMARY

In this regard, systems for stabilizing ladders are provided. A representative embodiment of such a system comprises a ladder stabilizing assembly that incorporates a mount, a frame and a spike. The mount is configured to attach to a ladder. The frame extends from the mount and is movable between a stowed position, in which the frame is located adjacent the ladder, and an un-stowed position, in which the frame extends outwardly from the ladder. The spike extends from the frame and is operative to be driven into the ground such that, when the frame is in the un-stowed position and the spike is driven into the ground, the ladder stabilizing assembly provides support to the ladder.

Another embodiment of such a system comprises a ladder stabilizing assembly that incorporates a mount, a frame and a spike assembly. In this embodiment, the mount is an elongate, semi-cylindrical member having an opening along a length thereof to facilitate attachment to a lower rung of a ladder such that the mount is operative to attach to the lower rung of the ladder. The frame has arms extending outwardly from the mount, with the frame being movable between a stowed position, in which the frame is located adjacent the ladder, and an un-stowed position, in which the frame extends outwardly from the lower rung of the ladder to which the mount is attached. The spike assembly has at least a first spike, with the spike assembly being attached to the frame and being movable between a retracted position, in which the first spike is parallel to the arms of the frame, and an extended position, in which the first spike extends outwardly from the arms of the frame. Additionally, the first spike is operative to be driven into the ground such that, when the frame is in the un-stowed position and the spike is driven at least partially into the ground, the ladder stabilizing assembly provides support to the ladder.

Another embodiment of such a system comprises a ladder stabilizing assembly that incorporates a mount, a frame and a spike assembly. In this embodiment, the mount is elongate and has an opening along a length thereof to facilitate attachment to a rung of a ladder. The mount is operative to attach to a rung of a ladder such that the rung is inserted through the opening and the mount is rotatable about the rung. The frame has arms extending outwardly from the mount in a wishbone configuration, with the frame being movable between a stowed position, in which the frame is located adjacent the ladder, and an un-stowed position, in which the frame extends outwardly from the rung of the ladder to which the mount is attached. The spike assembly has a pair of spikes spaced from and arranged parallel to each other, with the spike assembly being attached to the frame and being movable between a retracted position, in which the spikes are located between and parallel to the arms of the frame, and an extended position, in which the spikes extend outwardly from the arms of the frame. The spikes are operative to be driven into the ground such that, when the frame is in the un-stowed position and the spikes are driven at least partially into the ground, the ladder stabilizing assembly provides support to the ladder.

Other systems, methods, features and/or advantages will be or may become apparent to one with skill in the art upon examination of the following drawings and detailed description. It is intended that all such additional systems, methods, features and/or advantages be included within this description and be protected by the accompanying claims.

BRIEF DESCRIPTION OF THE DRAWINGS

The components in the drawings are not necessarily to scale relative to each other. Like reference numerals designate corresponding parts throughout the several views.

FIG. 7 is a perspective view of the embodiment of FIGS. 4-6 with the ladder stabilizing assembly in an un-stowed position with the spikes driven into the ground.

DETAILED DESCRIPTION

As will be described in greater detail here, systems for stabilizing ladders are provided. In this regard, such systems incorporate a ladder stabilizing assembly that can be coupled to a ladder, such as to a lower rung. In some embodiments, the ladder stabilizing assembly is movable between a stowed position, in which the assembly is generally flattened against the rungs of a ladder so that the ladder can be conveniently stored. When moved to an un-stowed position, a frame of the assembly extends outwardly from the ladder and serves as a mount for spikes that can be set into the ground for securing the base of the ladder. Notably, although use of a ladder stabilizing assembly can provide a substantial degree of support to a base of a ladder, there is no intention to replace the extra measure of safety that can be provided by a worker stabilizing the base of a ladder during use.

Figure 1:
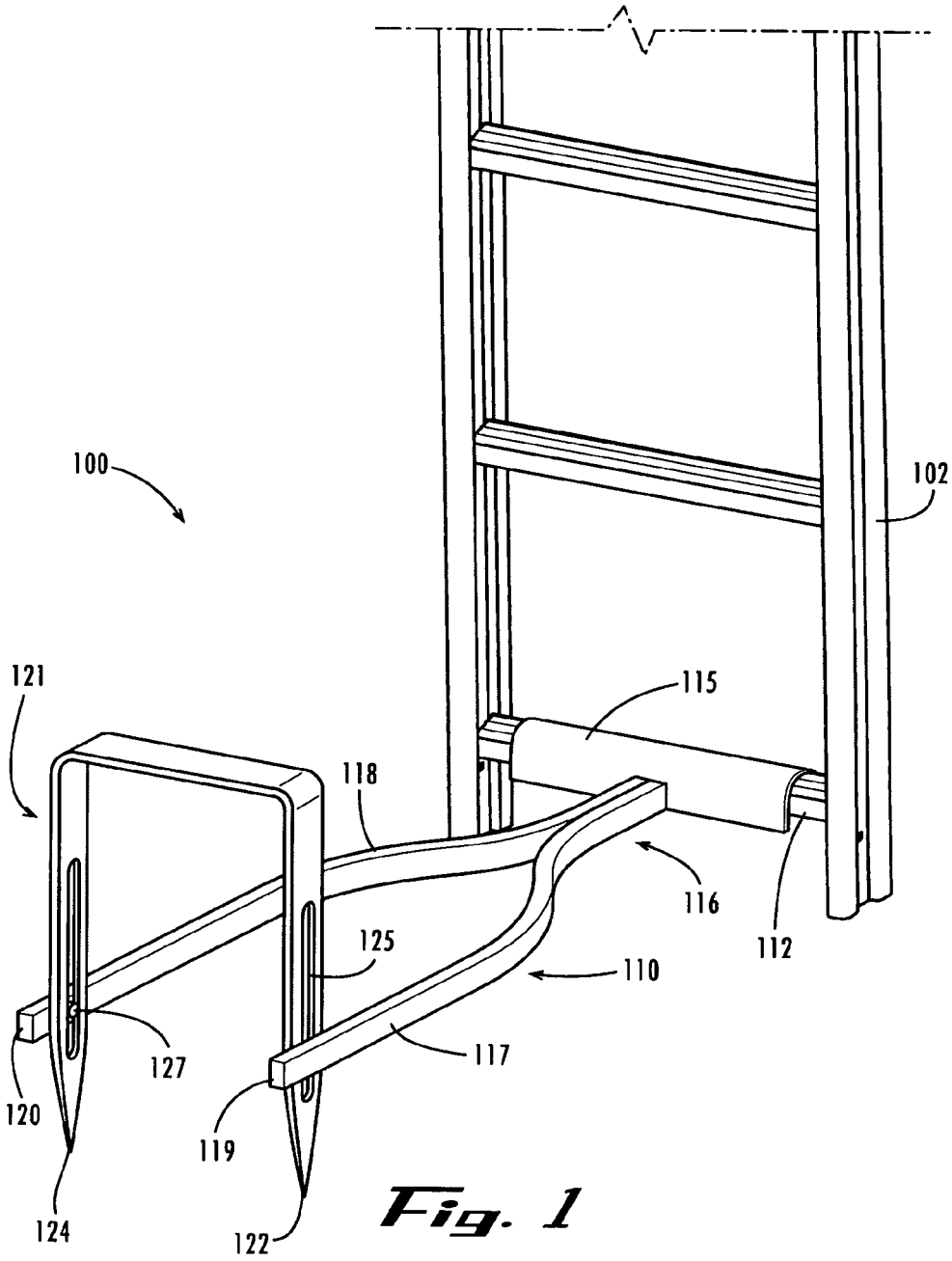
FIG. 1 is a partially cut-away perspective view of an embodiment of a system for stabilizing a ladder incorporating a ladder and a ladder stabilizing assembly.

Referring now in detail to the drawings, FIG. 1 is a partially cut-away perspective view of an embodiment of system 100 for stabilizing a ladder that incorporates a ladder 102 and a ladder stabilizing assembly 110. In particular, FIG. 1 depicts ladder stabilizing assembly 110 coupled to a lower rung 112 of the ladder. In this embodiment, the ladder stabilizing assembly incorporates a mount 115 that engages the ladder. A frame 116 extends outwardly from the mount. In this embodiment, the frame is configured as a wishbone-shaped member having opposing arms 117, 118, although various other configurations can be used in other embodiments.

Distal ends 119, 120 of the arms engage a spike assembly 121 that incorporates two spikes 122, 124. Clearly, other numbers and arrangements of spikes could be used in other embodiments. As used herein, the term spike denotes a protrusion that is configured to be driven into the ground and is not intended to infer any particular shape. However, in some embodiments, such spikes are tapered to a point.

In this embodiment, the spikes are spaced from each other and maintained in a generally parallel arrangement. The spike assembly is movable between a retracted position (shown in FIG. 2) and an extended position (shown in FIG. 1). In this embodiment, movement of the spike assembly between the retracted and extended positions is facilitated by elongated slots 125, 126, one of which is incorporated into each of the spikes. The slots cooperate with corresponding mounting posts 127, 128 that extend from the arms of the frame. In addition to facilitating attachment of the spikes to the frame, the mounting posts can incorporate flanged ends and associated locking components (not shown). By way of example, the posts can engage internal threads of wheels (which operate by engaging threaded ends of the posts) to facilitate securing of the spikes in the selected position.

Figure 2:
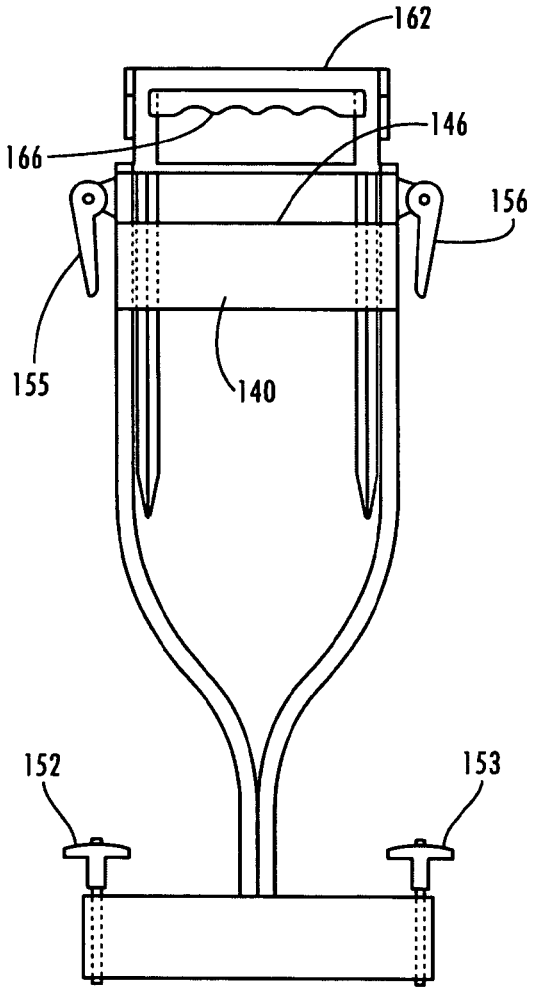
FIG. 2 is a plan view of another embodiment of a ladder stabilizing assembly.
Figure 3:
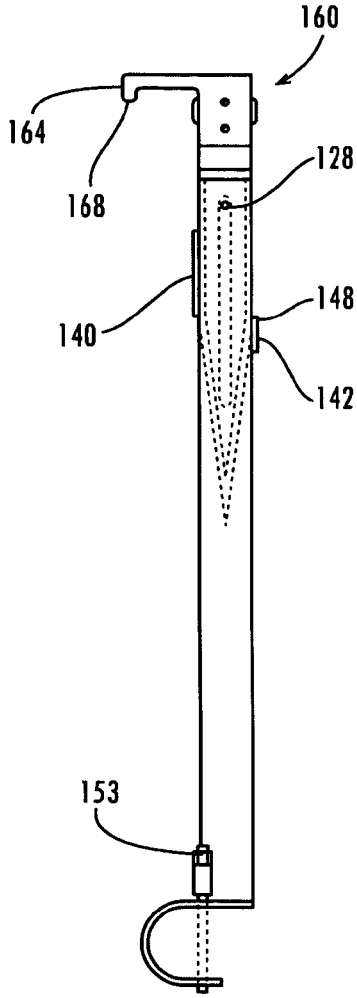
FIG. 3 is a side view of the embodiment of FIG. 2.

In FIGS. 2 and 3, the spikes are shown in the retracted position in which the spikes are oriented generally parallel to the arms of the frame. In this position, the pointed ends of the spikes tend to be obstructed by the frame, which tends to reduce the opportunity for injury.

In this embodiment, the spikes are maintained in the retracted position by a top keeper 140 and a bottom keeper 142, each of which spans between the opposing arms of the frame. The keepers are used to prevent the spikes from rotating when in the retracted position. In this embodiment, the upper edge 146 of the top keeper is closer to the ends of the arms of the frame than the top edge 148 of the bottom keeper. This configuration enables the sharpened tips of the spikes to be rotated downward and away from the top keeper as the spikes are moved from the retracted to the extended position. That is, the spikes can be rotated as the tips of the spikes clear the top edge 148 of the bottom keeper 142.

Note that the embodiment depicted in FIGS. 2 and 3 is slightly different than that depicted in FIG. 1. For instance, in contrast to the mount of FIG. 1, which is attached to the lower rung by crimped retention of the mount, the mount in the embodiment of FIGS. 2 and 3 incorporates releasable locking components 152, 153. Specifically, the embodiment of FIGS. 2 and 3 incorporates releasable locking components configured as quick release pins that can be inserted or removed to couple or alternatively uncouple the mount from the ladder. Clearly, the releasable locking components could be configured to be attached to the mount in various manners, such as by insertion of the components from the other side of the mount.

Thus, while some embodiments may include ladder stabilizing assemblies that are designed to be permanently attached to their respective ladders, other embodiments can be designed to be removable and used with various ladders as desired. It should also be noted that, in other embodiments, a mount could (additionally or alternatively) be configured to mount to a portion of a ladder other than a rung.

Another feature of distinction between the embodiment of FIG. 1 and that of FIGS. 2 and 3 relates to the spike assembly locking mechanism. That is, in contrast to the embodiment of FIG. 1, which includes internally threaded wheel assemblies for fixing a position of the spikes relative to the frame, the embodiment of FIGS. 2 and 3 incorporates a set of lever-operated push-pull clamps 155, 156. In other embodiments, various other components could be used.

In the embodiment of FIGS. 2 and 3, the clamps are operated by rotating respective levers that are hinged to corresponding internal pistons. In operation, rotation of the lever in one direction causes the distal end of the piston to retract toward the lever, thereby increasing frictional engagement since the distal end of the piston is flanged. Alternatively, rotation of the lever in the other direction causes the distal end of the piston to extend away from the lever, thereby loosening the clamp. The clamps are loosened to move the spike assembly from a stowed to an un-stowed position and then may be tightened when the spikes are driven into the ground to stabilize the ladder.

As another example, the embodiment of FIGS. 2 and 3 incorporates a stowage lock in the form of a handle extension 160. In particular, the handle 162 of the spike assembly incorporates a handle extension 164 that extends from a grip portion 166 of the handle. A lip 168 extends from an end of the handle extension 164. As such, the handle extension is configured to contact and slightly overlap a rung of the ladder when the assembly is moved to its stowed position and the lip helps to prevent the handle extension from slipping off of the rung.

Figure 4:
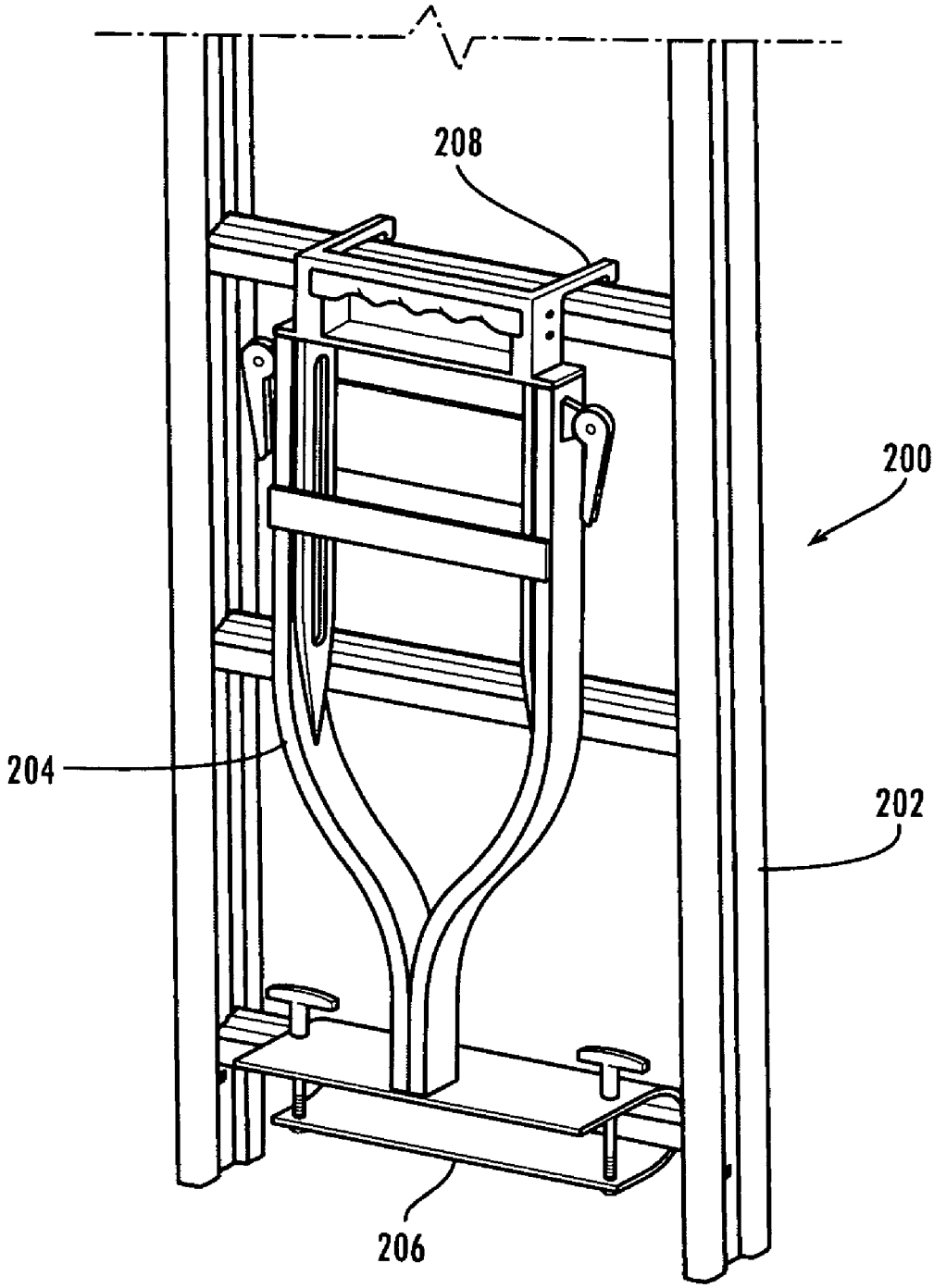
FIG. 4 is a perspective view of an embodiment of a system in which a ladder stabilizing assembly is shown in a stowed position.

FIG. 4 depicts another embodiment of a system for stabilizing a ladder. In particular, the system 200 of FIG. 4 incorporates a ladder 202 and a ladder stabilizing assembly 204. As shown in FIG. 4, the ladder stabilizing assembly is depicted in its stowed position. In this position, the mount 206 facilitates attachment of the ladder stabilizing assembly to a rung of the ladder while permitting the assembly to be rotated until the frame is generally parallel with the ladder. In this position, the system provides a relatively slender profile that is convenient for storage and/or transport. This embodiment also incorporates a locking member 208 that is configured to engage another rung of the ladder, thereby securing the movable end of the spike assembly in its stowed position.

Figure 4A:
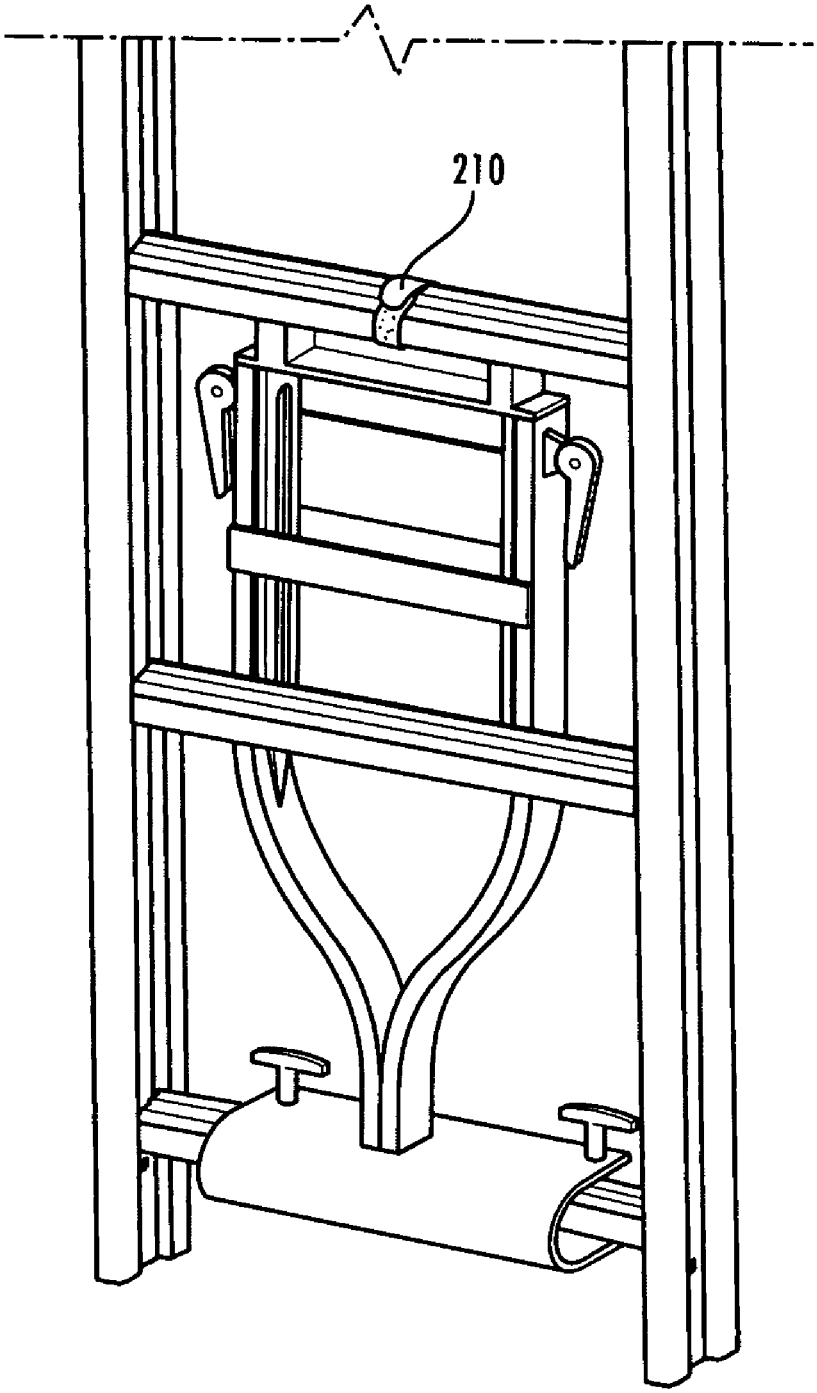
FIG. 4*a* is a perspective view of another embodiment of a system in which a ladder stabilizing assembly is shown in a stowed position.

Various other forms of stowage locks can be used in other embodiments. By way of example, FIG. 4*a* depicts an embodiment that uses a strap. In particular, strap 210 incorporates hook and loop fabric and is used to secure a movable end of the ladder stabilizing assembly to the ladder.

Figure 5:
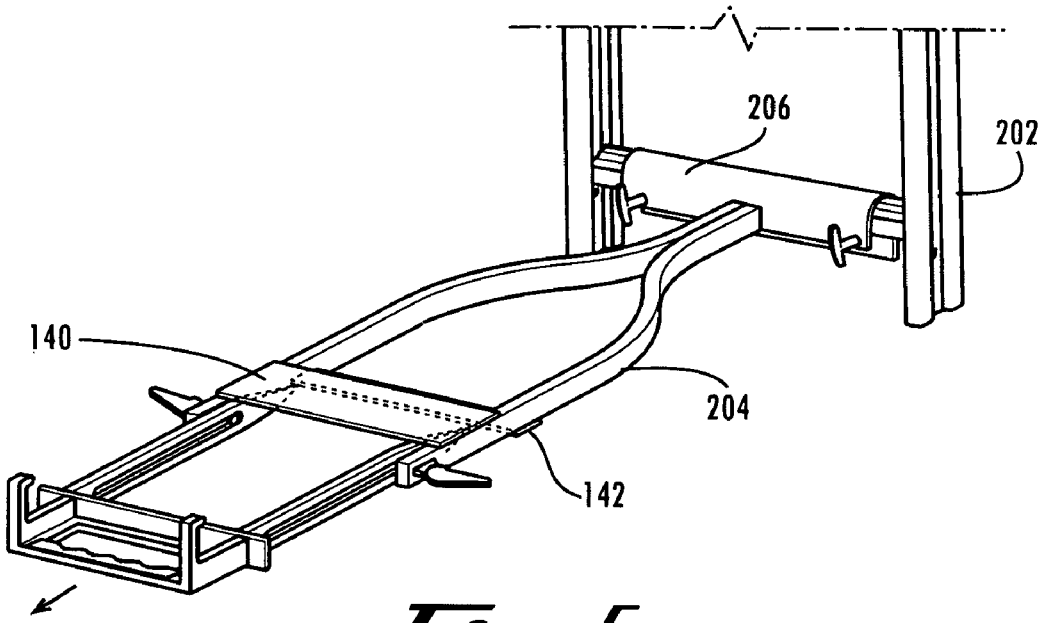
FIG. 5 is a perspective view of the embodiment of FIG. 4, showing the ladder stabilizing assembly in an un-stowed position, with the spikes retracted.

In contrast to the stowed position shown in FIG. 4, FIG. 5 depicts the embodiment of FIG. 4 in an un-stowed position with the spikes retracted. In this regard, the locking mechanism has been disengaged from the rung of the ladder and the spike assembly has been rotated about the mount so that the frame extends from the rung and away from the ladder. As mentioned before, various types of mounts can be used, some of which may require adjustment to facilitate movement of the frame between the stowed and un-stowed positions.

Figure 6:
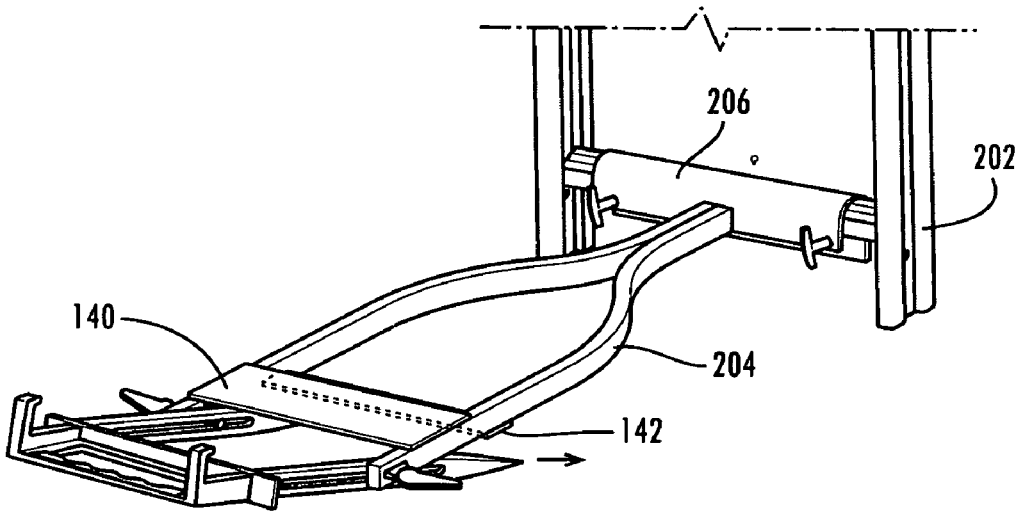
FIG. 6 is a perspective view of the embodiment of FIGS. 4 and 5 with the ladder stabilizing assembly in an un-stowed position with the spikes extended.
Figure 1:
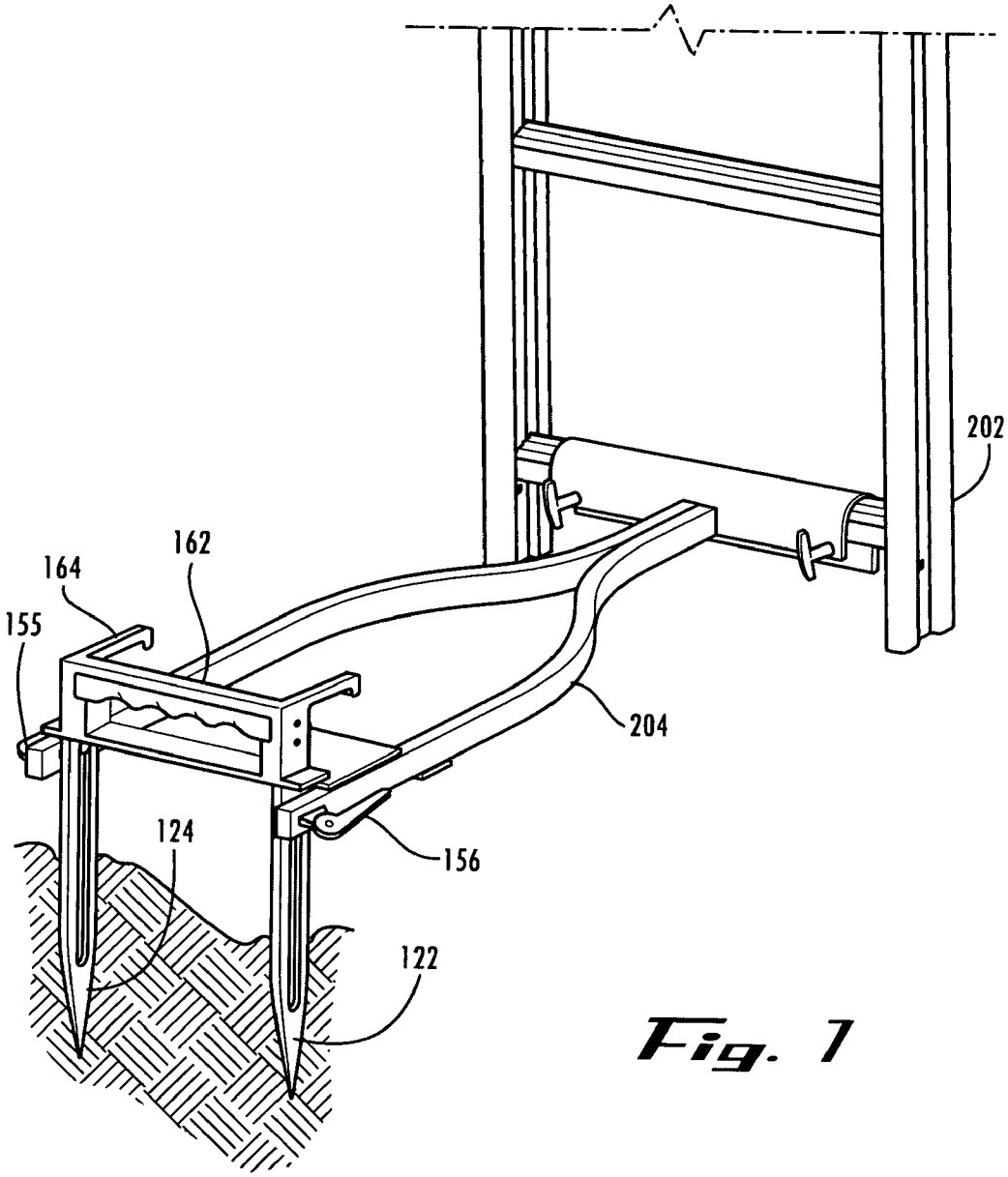

In FIG. 6, the embodiment of FIGS. 4 and 5 is depicted in an un-stowed position with the spikes having been moved from the retracted position to an intermediate position in which the distal ends of the spikes can clear the keepers.

In FIG. 7, the embodiment of FIGS. 4-6 is depicted in an un-stowed position with the spikes having been rotated to the extended position. Specifically, the spikes have been rotated and have been driven into the ground to provide support to the base of the ladder. Based upon principles of triangulation and the experience of the user, the base of the ladder is placed a certain distance from a wall or other structure, depending on the height to which the ladder is extended. It is necessary for the stability of the ladder and thus, the safety of the user, that the base not move from its initial position. Notably, in this embodiment, the upper portion of the handle 162 is suitably robust to be stomped on and/or tamped by a mallet, for example, to facilitate driving of the spikes into the ground.

As will be appreciated from the design, the ladder stabilizing assembly maintains the base of the ladder in place at the same distance from the wall, etc., from which it is deployed. This ensures that the base of the ladder will not slip or slide away from its initial chosen position and a worker can safely ascend the ladder, knowing it will remain stable.

It should be emphasized that many variations and modifications may be made to the above-described embodiments. By way of example, although the embodiments described herein incorporate the use of straight ladders, various other types of ladders, such as A-frame ladders could be used. All such modifications and variations are intended to be included herein within the scope of this disclosure and protected by the following claims.

The invention claimed is:

1. A system for stabilizing a ladder comprising:

a ladder stabilizing assembly having a mount, a frame and a spike assembly;

the mount being elongate and having an opening along a length thereof to facilitate attachment to a rung of a ladder, the mount being operative to attach to a rung of a ladder such that the rung is inserted through the opening and the mount is rotatable about the rung;

the frame having arms extending outwardly from the mount together forming a Y-shaped configuration, the frame being movable between a stowed position, in which the frame is located adjacent the ladder, and an un-stowed position, in which the frame extends outwardly from the rung of the ladder to which the mount is attached;

the spike assembly having a pair of spikes spaced from and arranged parallel to each other, the spike assembly being attached to the frame and being movable between a retracted position, in which the spikes are located between and parallel to the arms of the frame, and an extended position, in which the spikes extend outwardly from the arms of the frame, the spikes being operative to be driven into the ground such that, when the frame is in the un-stowed position and the spikes are driven at least partially into the ground, the ladder stabilizing assembly provides support to the ladder; and a top keeper and a bottom keeper, each of which extends between the arms of the frame, the top keeper and the bottom keeper being operative to prevent rotation of the spikes from the retracted position.

2. The system of claim 1, further comprising:

a stowage lock attached to the spike assembly, the stowage lock being operative to engage a rung of the ladder to which the ladder stabilizing assembly is attached such that engagement of the stowage lock with the rung secures the ladder stabilizing assembly in the stowed position.

3. The system of claim 1, wherein the mount is removably secured to the ladder.

4. A system for stabilizing a ladder comprising:

a ladder stabilizing assembly having a mount, a frame and a spike;

the mount being configured to attach to a ladder;

the frame extending from the mount and being movable between a stowed position, in which the frame is located adjacent the ladder, and an un-stowed position, in which the frame extends outwardly from the ladder;

the spike extending from the frame and being operative to be driven into the ground such that, when the frame is in the un-stowed position and the spike is driven into the ground, the ladder stabilizing assembly provides support to the ladder;

wherein the frame has two opposing arms that extend outwardly from the mount, the spike is a first of two spikes, and the spikes being movably mounted to the arms;

wherein the spikes are movable between a retracted position, in which the spikes are aligned with the arms of the frame, and an extended position, in which the spikes extend outwardly from the arms; and wherein the system further comprises a to keeper and a bottom keeper, each of which being configured as a plate that extends between the arms, the top keeper and the bottom keeper being operative to prevent rotation of the spikes from the retracted position.

5. The system of claim 4, wherein the mount is operative to attach to a rung of the ladder.

6. The system of claim 4, wherein the mount is removably secured to the ladder.

7. The system of claim 4, wherein the two opposing arms together forming a Y-shaped configuration.

8. The system of claim 4, further comprising:

a handle assembly; and a spike assembly carrying the spikes and attached to the handle assembly, the handle assembly being operative to be grasped by a user, the handle assembly and spike assembly being movable in unison with respect to the frame such that, as the handle assembly is moved and distal ends of the spikes are no longer obstructed by the bottom keeper, the spikes are able to be rotated to the extended position.

9. The system of claim 8, further comprising:

a stowage lock attached to the handle assembly, the stowage lock being operative to engage a rung of the ladder to which the ladder stabilizing assembly is attached such that engagement of the stowage lock with the rung secures the ladder stabilizing assembly in the stowed position.

10. The system of claim 4, further comprising the ladder.

11. A system for stabilizing a ladder comprising:

a ladder stabilizing assembly having a mount, a frame and a spike assembly;

the mount being an elongate, semi-cylindrical member having an opening along a length thereof to facilitate attachment to a lower rung of a ladder, the mount being operative to attach to the lower rung of the ladder;

the frame having arms extending outwardly from the mount, the frame being movable between a stowed position, in which the frame is located adjacent the ladder, and an un-stowed position, in which the frame extends outwardly from the lower rung of the ladder to which the mount is attached;

the spike assembly having at least a first spike, the spike assembly being attached to the frame and being movable between a retracted position, in which the first spike is parallel to the arms of the frame, and an extended position, in which the first spike extends outwardly from the arms of the frame, the first spike being operative to be driven into the ground such that, when the frame is in the un-stowed position and the spike is driven at least partially into the ground, the ladder stabilizing assembly provides support to the ladder; and a top keeper and a bottom keeper, each of which extends between the arms of the frame, the top keeper and the bottom keeper being operative prevent rotation of the first spike from the retracted position.

12. The system of claim 11, further comprising:

a handle assembly; and the spike assembly carrying the at least one spike and attached to the handle assembly, the handle assembly being operative to be grasped by a user, the handle assembly and spike assembly being movable in unison with respect to the frame such that, as the handle assembly is moved and distal ends of the spikes are no longer obstructed by the bottom keeper, the spikes are able to be rotated to the extended position.

13. The system of claim 12, further comprising:

a stowage lock attached to the handle assembly, the stowage lock being operative to engage a rung of the ladder to which the ladder stabilizing assembly is attached such that engagement of the stowage lock with the rung secures the ladder stabilizing assembly in the stowed position.

14. The system of claim 11, further comprising the ladder.

* * * * *